US010234226B1

(12) United States Patent
Copeland

(10) Patent No.: US 10,234,226 B1
(45) Date of Patent: Mar. 19, 2019

(54) BOLT CATCH APPARATUS AND METHOD FOR SELECTIVELY FIXING THE MAGAZINE OF A FIREARM

(71) Applicant: Craig William Copeland, Fallbrook, CA (US)

(72) Inventor: Craig William Copeland, Fallbrook, CA (US)

( * ) Notice: Subject to any disclaimer, the term of this patent is extended or adjusted under 35 U.S.C. 154(b) by 0 days.

(21) Appl. No.: 15/952,953

(22) Filed: Apr. 13, 2018

Related U.S. Application Data

(63) Continuation-in-part of application No. 15/893,598, filed on Feb. 10, 2018.

(60) Provisional application No. 62/457,642, filed on Feb. 10, 2017.

(51) Int. Cl.

| | |
|---|---|
| ***F41A 17/38*** | (2006.01) |
| ***F41A 17/36*** | (2006.01) |
| ***F41A 11/02*** | (2006.01) |
| ***F41A 3/66*** | (2006.01) |

(52) U.S. Cl.
CPC ..... *F41A 17/38* (2013.01); *F41A 3/66* (2013.01); *F41A 11/02* (2013.01); *F41A 17/36* (2013.01)

(58) Field of Classification Search
CPC .... F41A 9/61; F41A 9/65; F41A 17/00; F41A 17/34; F41A 17/38
USPC ..... 42/49.01, 6, 50, 16, 18, 70.01, 70.02
See application file for complete search history.

(56) References Cited

U.S. PATENT DOCUMENTS

| | | | | |
|---|---|---|---|---|
| 5,519,954 | A * | 5/1996 | Garrett | F41A 17/38 42/6 |
| 6,070,352 | A * | 6/2000 | Daigle | F41A 11/02 42/49.02 |
| 6,173,519 | B1 * | 1/2001 | Garrett | F41A 17/38 42/70.01 |
| 7,661,219 | B1 * | 2/2010 | Knight, Jr. | F41A 3/42 42/17 |
| 8,756,845 | B2 | 6/2014 | Harris et al. | |
| D717,905 | S * | 11/2014 | Prince | F41A 3/42 D22/108 |
| 9,010,004 | B1 * | 4/2015 | Fu | F41A 17/38 42/49.01 |
| 9,121,651 | B1 * | 9/2015 | Jen | F41A 17/38 |
| 9,182,186 | B1 * | 11/2015 | Prince | F41A 17/38 |
| 9,234,715 | B2 * | 1/2016 | Cassady | F41A 9/61 |
| 9,777,977 | B1 | 10/2017 | Makaron | |
| 9,823,031 | B2 | 11/2017 | Robbins et al. | |
| 2006/0123683 | A1 * | 6/2006 | Garrett | F41A 17/38 42/6 |
| 2013/0227869 | A1 * | 9/2013 | Thordsen | F41C 27/00 42/6 |

(Continued)

OTHER PUBLICATIONS 33.3 Tactical, "33.3 Tactical CalCatch Installation", Published Jul. 15, 2017, YouTube, Entire Video, <https://www.youtube.com/watch?v=6jUp9qUeVQE>. (Year: 2017).*

(Continued)

*Primary Examiner* — Jonathan C Weber
(74) *Attorney, Agent, or Firm* — Lodestone Legal Group; Jeromye V. Sartain

(57) ABSTRACT

Apparatuses and methods to convert a semi-automatic firearm with a detachable magazine to a semi-automatic firearm with a fixed magazine and release mechanism, including one or more of a catch plate, a modified bolt catch, and/or a modified magazine release bar.

20 Claims, 8 Drawing Sheets

(56) References Cited

U.S. PATENT DOCUMENTS

| | | | | |
|---|---|---|---|---|
| 2013/0269232 | A1* | 10/2013 | Harris | F41A 9/64 42/49.01 |
| 2014/0053444 | A1* | 2/2014 | Garrett | F41A 17/38 42/6 |
| 2014/0165439 | A1* | 6/2014 | Fernandez | F41A 17/38 42/6 |
| 2015/0052793 | A1* | 2/2015 | Cassady | F41A 17/38 42/8 |
| 2017/0227312 | A1* | 8/2017 | Christensen | F41A 9/65 |
| 2018/0017347 | A1 | 1/2018 | Chang et al. | |
| 2018/0058787 | A1 | 3/2018 | Chang et al. | |

OTHER PUBLICATIONS

Citizen One, "Fixed mag setup, 33.3 Tactical CalCatch + (Various limited pivot pins)", Published Jun. 28, 2017, CalGuns.net Forum, Entire Thread, <https://www.calguns.net/calgunforum/showthread.php?t=1350449>. (Year: 2017).*

* cited by examiner

BOLT CATCH APPARATUS AND METHOD FOR SELECTIVELY FIXING THE MAGAZINE OF A FIREARM

RELATED APPLICATIONS

This is a continuation-in-part application and so claims the benefit pursuant to 35 U.S.C. § 120 of a prior filed and co-pending U.S. Non-Provisional patent application Ser. No. 15/893,598 filed Feb. 10, 2018, and entitled "Device and Method for Selectively Fixing the Magazine of a Firearm," which itself claims priority pursuant to 35 U.S.C. § 119(e) to and is entitled to the filing date of U.S. Provisional Patent Application Ser. No. 62/457,642 filed Feb. 10, 2017, and entitled "Device and Method for Selectively Fixing the Magazine of an Assault Weapon." The contents of the aforementioned applications is incorporated herein by reference.

BACKGROUND

The subject of this patent application relates generally to firearms, and more particularly to apparatuses and methods configured for selectively fixing the magazine of a firearm that could otherwise be characterized as an assault weapon.

The following description includes information that may be useful in understanding the present invention. It is not an admission that any of the information provided herein is prior art or relevant to the presently claimed invention, or that any publication specifically or implicitly referenced is prior art.

Applicant(s) hereby incorporate herein by reference any and all patents and published patent applications cited or referred to in this application, to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

By way of background, the current law in at least five U.S. states bans the sale of assault weapons that have a removable magazine or ammunition feeding device (i.e., rifles such as the "AR15" or "AR10" that do not have a "fixed magazine"). In California under Assembly Bill 1135 and Senate Bill 880, a "fixed magazine" is now defined as "an ammunition feeding device contained in, or permanently attached to, a firearm in such a manner that the device cannot be removed without disassembly of the firearm action." Such legislation, which went into effect in the relevant jurisdictions on Jan. 1, 2017, was essentially aimed at closing the "bullet button" loop hole by now categorizing "bullet button" removable magazine firearms as assault weapons.

The law has long been that certain rifles with detachable magazines and other such features were classified as assault weapons under California and other state law. In response, gun owners and manufacturers sought various ways to obtain certain styles of rifles similar to those determined to be assault weapons or to effectively retrofit such weapons to take them out of the definition of an "assault weapon," such as by rendering the magazine "fixed" rather than removable. One of the most common modifications up to 2016 had been the use of a part known as a "bullet button," which modifies a rifle so that the magazine is not removable without the use of a tool (a bullet being deemed a "tool" under the law, hence the term "bullet button tool").

Then, starting in 2017 the law again changed to prohibit the "bullet button" as by defining an "assault weapon," and a "fixed magazine" specifically, in such a way that a semi-automatic rifle must be "disassembled" before the magazine can be removed. Since this law was first proposed in April 2016, a number of products have entered the market to address this issue. A few attach to the magazine release button and touch the upper receiver so that the upper and lower receiver must be opened for the button to work (i.e., the firearm is rendered "disassembled," at least to the extent that it cannot be fired (the "firearm action" is disabled). Others have pins that need to be machined into the firearm to fix the magazine release button. One example of a prior art approach is shown in U.S. Pat. No. 8,756,845 to Harris et al. entitled "Method and Device for Converting Firearm with Detachable Magazine to a Firearm with Fixed Magazine," which requires removal and replacement of the factory installed magazine release button assembly, including both the magazine release button and the factory installed magazine catch bar, such components being replaced with a modified magazine catch bar and an integral upper tension bar. Other approaches such as disclosed in U.S. Patent Application Publication No. US2018/0017347 to Chang and entitled "Tool and Method for Modifying a Magazine Lock" involve installation or formation of a magazine locking pin within a related aperture in the lower receiver, and a related jig, so as to render the magazine release button inoperable when the upper receiver is next to the lower receiver and the magazine locking pin is engaged with a locking catch formed in the magazine release button, thus again requiring modification of both the magazine release button assembly and here of the lower receiver itself. In still further approaches, such as in the "Hellfighter CA Mod Kit" recently introduced by Juggernaut Tactical, though after the introduction of the present invention, rather than modifying the magazine release button assembly, the bolt catch is removed and replaced with a component configured to selectively contact the upper and lower receivers, and specifically the magazine release bar, so as to prevent actuation of the magazine release button and release of the magazine until the upper receiver is shifted away from the lower receiver so as to disassemble or break the action of the firearm, though in this approach the firearm is undesirably rendered as having no bolt catch. As such, there remains a need in the art for a more convenient and effective manner for selectively fixing the magazine of a firearm or locking the magazine release button assembly or preventing its actuation until the firearm is "disassembled" or rendered inoperable.

Aspects of the present invention fulfill these needs and provide further related advantages as described in the following summary.

SUMMARY

Aspects of the present invention teach certain benefits in construction and use which give rise to the exemplary advantages described below.

The present invention solves the problems described above by providing bolt catch apparatuses and methods configured for selectively fixing the magazine of a firearm that could otherwise be characterized as an assault weapon. In at least one embodiment, the invention relates to apparatuses and methods to convert a semi-automatic firearm with a detachable magazine to a semi-automatic firearm with a fixed magazine and release mechanism.

Other objects, features, and advantages of aspects of the present invention will become more apparent from the following detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

Figure 1:
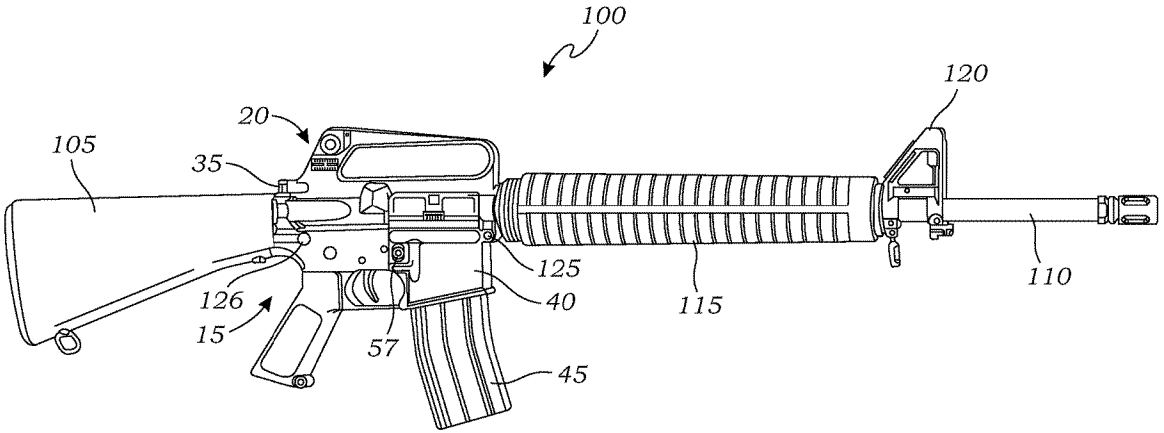
FIG. 1 is a right side view of an illustrative firearm as retrofitted with an exemplary apparatus for selectively fixing the magazine thereof, in accordance with at least one embodiment.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments. More generally, those skilled in the art will appreciate that the drawings are schematic in nature and are not to be taken literally or to scale in terms of material configurations, sizes, thicknesses, and other attributes of an apparatus according to aspects of the present invention and its components or features unless specifically set forth herein.

DETAILED DESCRIPTION

The following discussion provides many exemplary embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

While the inventive subject matter is susceptible of various modifications and alternative embodiments, certain illustrated embodiments thereof are shown in the drawings and will be described below in detail. It should be understood, however, that there is no intention to limit the invention to any specific form disclosed, but on the contrary, the inventive subject matter is to cover all modifications, alternative embodiments, and equivalents falling within the scope of the claims.

At a high level and by way of further introduction, the present invention relates generally to semi-automatic firearms and to an apparatus and method for converting such a semi-automatic firearm from a fully-functioning firearm to a firearm having a selectively fixed magazine, doing so in a safe, effective, and legally-compliant manner. According to an aspect of the present invention, such selective locking of the magazine is achieved through a modification to the bolt catch, or more particularly the installation of a catch plate operably adjacent to the modified bolt catch and configured to selectively contact both the upper receiver and the magazine release bar and thereby prevent actuation of the magazine release button assembly until the firearm is "disassembled" or rendered inoperable, as by shifting the upper receiver off of the lower receiver sufficiently to take the catch plate out of contact with the upper receiver and thereby allow the catch plate to shift out of contact with the magazine release bar. Those skilled in the art will appreciate that a standard rear takedown pin that may be pulled to disengage the upper receiver from the lower receiver at the back end and allow the upper receiver to then selectively pivot relative to the lower receiver about a standard front pivot pin, or any other such components now known or later developed, may be employed in conjunction with an apparatus according to aspects of the present invention without departing from its spirit and scope in order to selectively shift the firearm from a "closed" position wherein the firearm is fully operational to an "open" position wherein the upper receiver is separated from the lower receiver to "break the action" of the firearm and render it disassembled or non-operational. As will be appreciated from the below detailed description, such goals may be achieved according to aspects of the present invention in a number of alternative embodiments or configurations, such that the exemplary embodiments shown and described are to be appreciated as illustrative and non-limiting.

Figure 2:
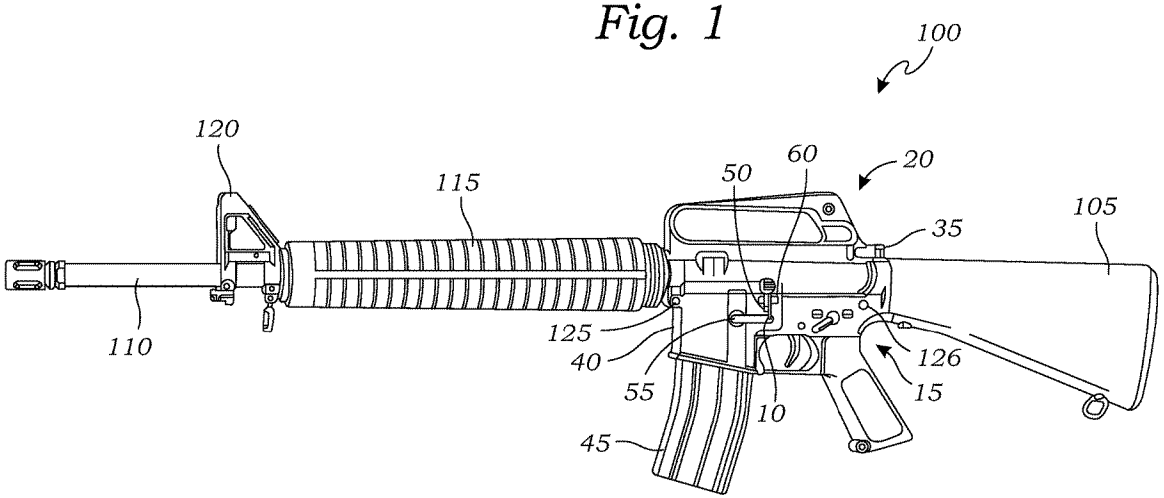
FIG. 2 is a left side view thereof, in accordance with at least one embodiment.

Turning now to FIGS. 1 and 2, there are shown right and left side views of an illustrative prior art firearm 100, here depicted as a traditional "AR15" rifle, having incorporated therein an exemplary embodiment of an apparatus according to aspects of the present invention. While the exemplary context is an "AR15" rifle, it will be appreciated that such is illustrative and non-limiting and that aspects of the invention may be employed with a variety of firearms now known or later developed without departing from its spirit and scope, including but not limited to "AR10" firearms. Since the "AR" type firearm is well-known, only the parts of the firearm essential to an understanding of the invention will be shown and/or described in detail. And although the present invention will be described with reference to the exemplary embodiments shown in the drawings, it should be understood that the present invention can be embodied in many alternate forms or embodiments. In addition, any suitable size, shape or type of elements or material could be used, such that anything shown or described is to be understood as illustrative and non-limiting. More generally, those skilled in the art will again appreciate that the drawings are schematic in nature and are not to be taken literally or to scale in terms of material configurations, sizes, thicknesses, and other attributes of the apparatus and its various components. Even so, where noted, particular dimensional callouts are provided for a catch plate 10 according to aspects of the present invention in alternative embodiments configured for the AR10 or AR15 rifles, again by way of illustration and not limitation.

Referring to the right side view of FIG. 1, the firearm 100 is generally comprised of a lower receiver 15 and an upper receiver 20. The upper receiver 20 houses the bolt (not shown) and charge handle 35 along with the forward barrel 110 and any related accessories such as the handguard 115 and front sight 120. The lower receiver 15 is comprised of the magazine well 40, the magazine 45, and the magazine release button 57, along with the rearward buttstock 105 and buffer tube (not shown). A standard front pivot pin 125 is installed forwardly and a standard rear takedown pin 126 is installed rearwardly so as to mount the upper receiver 20 onto the lower receiver 15, as further appreciated with reference to the exploded view of FIG. 3. Alternatively, a rear cam pin (not shown) may be installed in place of the rear takedown pin along with other components as disclosed in co-pending and commonly owned U.S. patent application Ser. No. 15/893,601 filed Feb. 10, 2018 and entitled "Device and Method for Selectively Disassembling a Firearm" so as to facilitate selective pivoting of the upper receiver 20 relative to the lower receiver 15. Or, again, any other such component now known or later developed may be employed for purposes of selectively disassembling the firearm or allowing the upper receiver 20 to at least partially shift off of or away from the lower receiver 15. Once so installed as shown in the closed position of the firearm 100, by pulling the rear takedown pin 126 in a manner known in the art, the upper receiver 20 will be separated from or be able to pivot off of the lower receiver 15, which again renders the firearm 100 inoperable or disassembled. At this point the magazine release button 57 can be depressed to remove the magazine 45 from the magazine well 40, more about which is also said below in connection with the catch plate 10 component of the apparatus. Then shifting or pivoting the upper receiver 20 back onto the lower receiver 15 and reengaging the rear takedown pin 126 in the lock position, the gap is again closed between the upper and lower receivers 20, 15, placing the weapon back into a firing condition or reassembled. It will be appreciated that the temporary separation between the upper and lower receivers 20, 15 allows the catch plate 10 (FIG. 2) to no longer contact the upper receiver 20 and shift or pivot upwardly and/or inwardly as the magazine release bar 55 (FIG. 2) is forced outward away from the lower receiver 15 by depressing the magazine release button 57. This allows the magazine 45 to release from the magazine well 40 and be replaced with another. Then, once more, the upper receiver 20 is again closed on the lower receiver 15 and the rear takedown pin 126 reinserted such that the firearm 100 is back in an assembled condition and ready to be charged, with the magazine release button 57 locked through the contact of the catch plate 10 with the magazine release bar 55 and with the upper receiver 20, again, more about which is said below, particularly in connection with FIGS. 7-10.

Similarly, turning to the left side view of FIG. 2, in the exemplary embodiment, though shown still "assembled," "disassembly" of the weapon 100 for purposes of rendering it inoperable and selectively releasing the magazine 45 is again accomplished here by simply pulling the rear takedown pin 126 so as to disengage it from the upper receiver 20, wherein the upper receiver 20 is pivoted off of the lower receiver 15 about the front pivot pin 125 until the desired separation between the upper and lower receivers 20, 15 is achieved and actuation of the magazine release button 57 (FIG. 1) is enabled. It will be appreciated that in such disassembled configuration the charge handle 35 cannot be actuated to charge the firearm 100. The upper end or upper edge 12 (FIG. 5) of the catch plate 10 is now separated from the upper receiver 20 enabling the catch plate 10 to pivot and/or shift upwardly on or along its cross-hole 11 (FIG. 5) so as to temporarily position the lower receiver touch tip 14 (FIG. 5) of the catch plate 10 clear of the magazine release bar 55. This allows the magazine release button 57 (FIG. 1) on the opposite side of the firearm 100 to be depressed and push the magazine release bar 55 outwardly so as to release or replace the magazine 45. Then shifting the upper and lower receivers 20, 15 back into contact with each other and reinserting the rear takedown pin 126 as shown in FIGS. 1 and 2, and the catch plate 10 is now again substantially in contact with the upper receiver 20 and the magazine release bar 55, thereby preventing actuation of the magazine release button 57 and outward movement of the magazine release bar 55 to release the magazine 45 when the firearm 100 is assembled or in its operational state, thus rendering the magazine 45 "fixed." As such, it will be appreciated that both FIGS. 1 and 2 illustrate the firearm 100 in the closed position with the catch plate 10 contacting the upper receiver 20. This again does not allow the magazine 45 to be released from the firearm 100 or now creates a "fixed magazine" weapon. It will be appreciated once more by those skilled in the art that a variety of such mechanical arrangements, both in terms of geometry and dimension, are possible according to aspects of the present invention, such that the apparatus illustrated is to be understood as exemplary and non-limiting. Relatedly, it will be appreciated that while the apparatus is shown and described in a "right-hand" arrangement, the parts and their assembly can be "mirrored" or "flipped" to the other side of the firearm 100 for effectively a left-hand configuration; or, in other embodiments the components may be installed so as to be operated from either side, or in effectively an "ambidextrous" arrangement—particularly, a variety of ambidextrous bolt catch components, whether factory-installed or after-market and whether now known or later developed, may be employed in conjunction with an apparatus, and particularly a catch plate 10, according to aspects of the present invention without departing from its spirit and scope, such that the exemplary bolt catch 50 is to be understood as merely illustrative and non-limiting. Notably, with continued reference to FIG. 2, and as will be further appreciated from the below more detailed description, the standard bolt catch 50 may simply be modified as by having a portion of its body made thinner, either as formed or through a subsequent machining operation, so as to allow for operable installation of the catch plate 10 alongside the bolt catch 50 without removing the bolt catch 50 altogether or in any way rendering it inoperative or requiring any modification whatsoever to the lower receiver 15 itself. Those skilled in the art will appreciate that, advantageously, an apparatus, and again particularly a catch plate 10, according to aspects of the present invention thus may be operably installed on a firearm 100 such as the illustrated "AR15" rifle without any change to the standard magazine release button assembly (magazine release button 57 and magazine release bar 55) or removal or any inoperability of the bolt catch 50, it in fact being in all respects standard in its configuration and operation other than having a relatively thinner body section to accommodate the catch plate 10 within the fixed gap defined between the opposed bolt catch mounts 60 of the lower receiver 15, again, more about which is said below, particularly in connection with FIG. 7.

Figure 3:
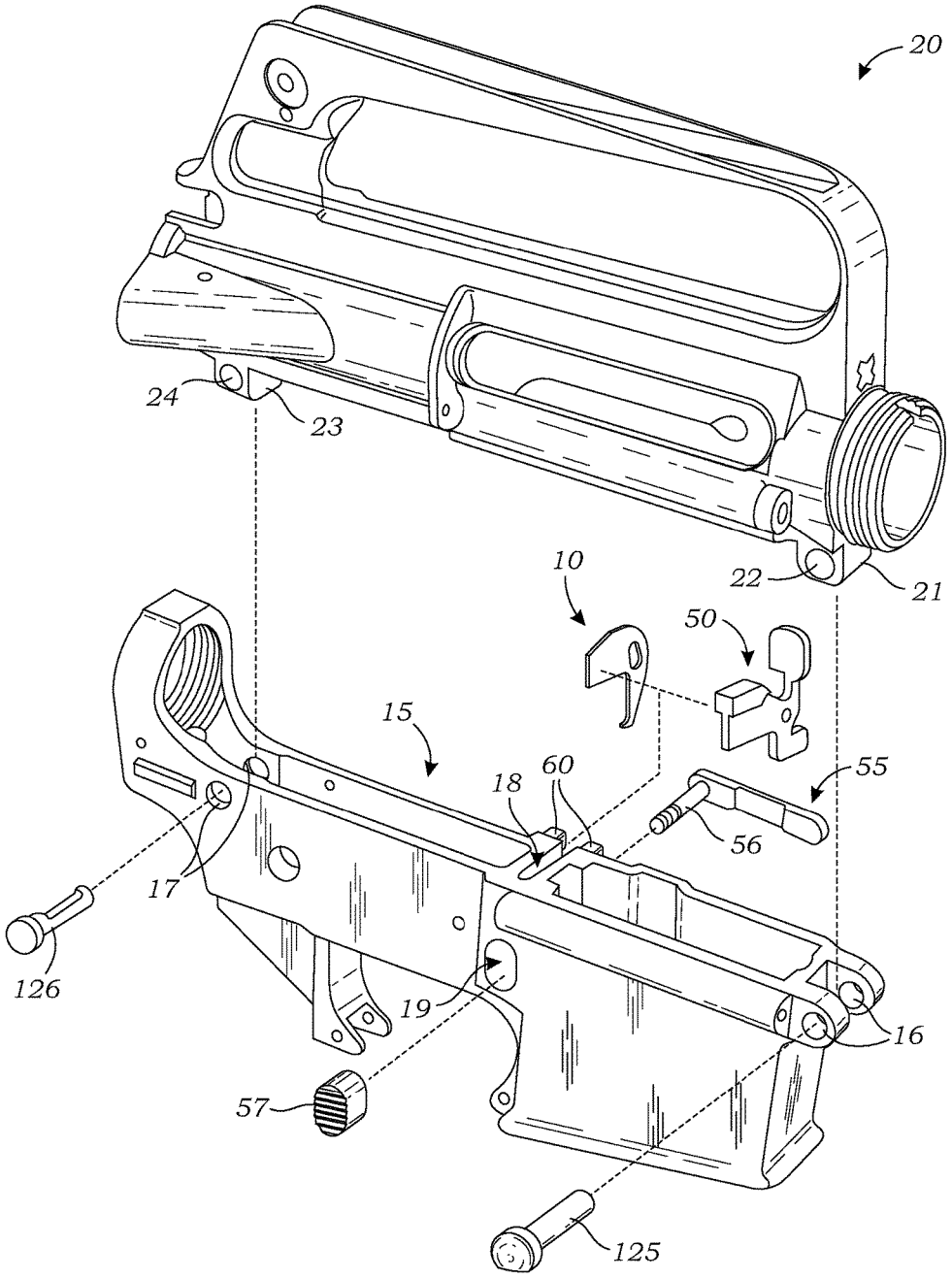
FIG. 3 is an enlarged, exploded, partial perspective view of an upper and lower receiver thereof and related components, in accordance with at least one embodiment.
Figure 4:
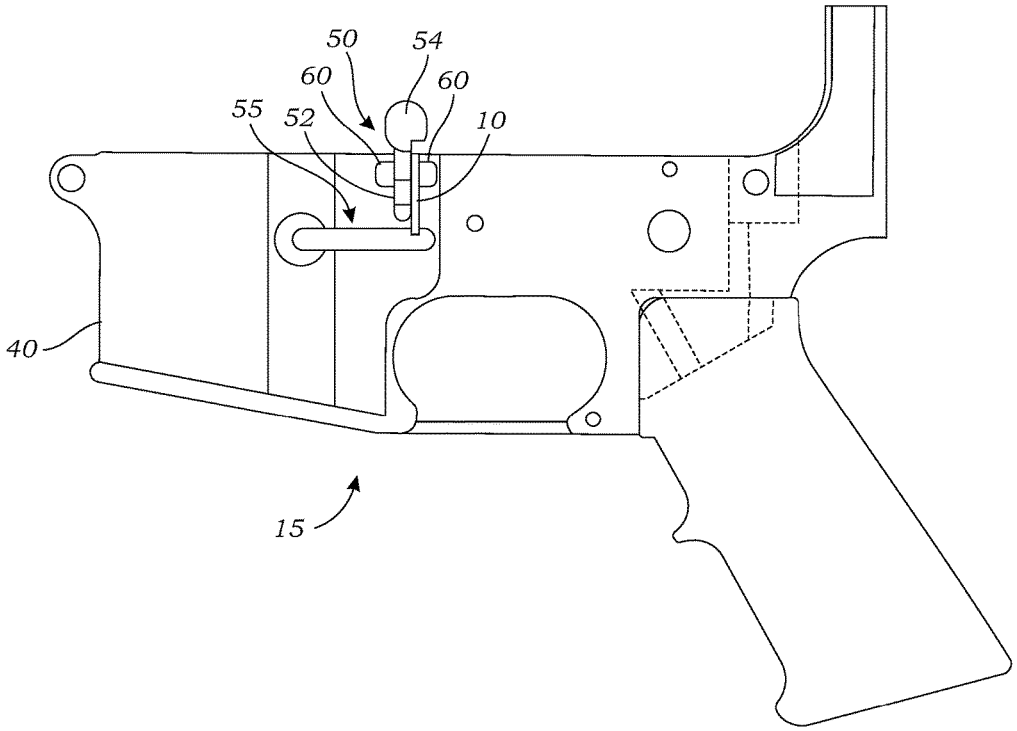
FIG. 4 is an enlarged, partial left side view of a lower receiver thereof and related components, in accordance with at least one embodiment.

Referring briefly to FIG. 3, there is shown an enlarged, exploded, partial perspective view of a portion of the firearm 100 (FIGS. 1 and 2), or essentially just the upper and lower receivers 20, 15 thereof and some related components of the apparatus and the associated firearm 100. As a threshold matter, the receivers 20, 15 are shown substantially stripped down, with no buttstock 105 (FIGS. 1 and 2) or buffer tube (not shown) on the lower receiver 15 or even trigger assembly, etc., and no barrel 110, handguard 115, or front sight 120 (FIGS. 1 and 2) or bolt (not shown) and charging handle 35 on the upper receiver 20, all such components being standard in the industry and removed here for simplicity. As shown, the magazine catch bar or release bar 55 and related magazine release button 57 and bolt catch 50 are depicted, each standard as part of the illustrated AR15 rifle 100 except as noted regarding the bolt catch 50, and further illustrated in connection with installation of the catch plate 10 as also shown in FIG. 4. Shown particularly in FIG. 3 are the bolt catch well 18 formed in the lower receiver 15 for receipt of the body 52 of the bolt catch 50, and now the respective portion of the catch plate 10, as they are pivotally installed together as herein described between the opposed bolt catch mounts 60 that flank the bolt catch well 18 on the outside upper portion of the side of the lower receiver 15. Also shown is the magazine release bore 19 formed in the lower receiver 15 substantially beneath the bolt catch well 18 in and through which the magazine release assembly (magazine release bar 55 and button 57) are installed. Also shown in FIG. 3 are the exemplary standard front pivot pin 125 and rear takedown pin 126 for together selectively assembling the upper receiver 20 onto the lower receiver 15. Once again, while a standard rear takedown pin 126 is shown, it will be appreciated that a rear cam pin (not shown) or other such component may replace the standard rear takedown pin 126 for disassembling the firearm 100, which rear cam pin may allow the upper receiver 20 and the lower receiver 15 to separate but not completely disassemble as by having the rear cam pin still engaged with the rear mounting bracket 23 while pivoting the upper receiver 20 slightly off of the lower receiver 15 about the front pivot pin 125. In a bit more detail, and as known in the art, in the configuration shown, the front pivot pin 125 pivotally joins the upper and lower receivers 20, 15 as by passing through one of the front lower receiver cross-holes 16, the front upper receiver cross-hole 22 formed in the upper receiver front mounting bracket 21, and then the opposite front lower receiver cross-hole 16. Similarly, rearwardly, the rear takedown pin 126 is inserted through one of the rear lower receiver cross-holes 17, the rear upper receiver cross-hole 24 formed in the upper receiver rear mounting bracket 23, and then the opposite front lower receiver cross-hole 17, thereby selectively securing the upper receiver 20 on the lower receiver 15. Though not shown, optionally, a spring member may be selectively employed to aid in the task of causing the pivot of the upper receiver 20 off of the lower receiver 15 or creating the gap therebetween when the rear takedown pin 126 is selectively pulled, as by effectively providing a spring-biased or spring-assisted linear force directed toward the upper receiver 20 from the lower receiver 15.

Turning next to FIG. 4, there is shown an enlarged left side view of the "stripped down" lower receiver 15 for simplicity, showing the modified bolt catch 50 and the opposite bolt catch mounts 60 as well as the magazine release bar 55, all of which again being standard components of the illustrated AR15 rifle 100 and other such firearms, and with all of which the catch plate 10 interacts. Particularly, the catch plate 10 is shown as being installed on the side of the bolt catch 50 as by being positioned immediately adjacent to and substantially parallel to the body 52 of the bolt catch 50 and also installed between the opposed bolt catch mounts 60 by simply positioning the bolt catch 50 and the catch plate 10 between the bolt catch mounts 60 and aligning the bolt catch cross-hole 51 (FIG. 6) and the catch plate cross-hole 11 (FIG. 5) with each other and with the holes (not shown) in the bolt catch mounts 60 and then inserting the threaded mounting screw 25 (FIGS. 7 and 8), roll pin, or other such fastener now known or later developed to pivotally secure the bolt catch 50 and catch plate 10 on the lower receiver 15 as shown. In the exemplary embodiment, the mounting screw 25 holds the catch plate 10 and the bolt catch 50 itself as previously within the bolt catch mount 60 so that the catch plate 10 makes contact with the magazine release bar 55 and the upper receiver 20 (FIGS. 1 and 2) at the same time, as described herein. When the rear takedown pin 126 (FIGS. 1-3) is pulled and the upper receiver 20 shifted up and away from the lower receiver 15, the upper edge 12 of the catch plate 10 is spaced from the upper receiver 20 and can move upwardly and somewhat inwardly so as to allow the magazine release button 57 (FIGS. 1 and 3) to be depressed to shift the magazine release bar 55 outwardly. This allows the magazine 45 (FIGS. 1 and 2) to be removed from the magazine well 40 (FIGS. 1 and 2). As the button 57 is released and moves back into the loading position, the magazine release bar 55 shifts inwardly, allowing the catch plate 10 to shift back down and over the magazine release bar 55 as the upper and lower receivers 20, 15 are brought back into contact to reassemble the firearm 100 (FIGS. 1 and 2). By removing the magazine catch pin or tang (not shown) from the standard bolt catch 50, the bolt (not shown) will not stay open after the last round has been fired, but instead the bolt and hammer will come forward, which eliminates one further step in the disassembly of the firearm 100 or enables immediate disassembly using the rear takedown pin 126 or other component. Those skilled in the art will once again appreciate that a variety of means now known or later developed for biasing the upper receiver 20 away from the lower receiver 15 may be employed along with the rear takedown pin 126 or the like according to aspects of the present invention without departing from its spirit and scope.

Figure 5:
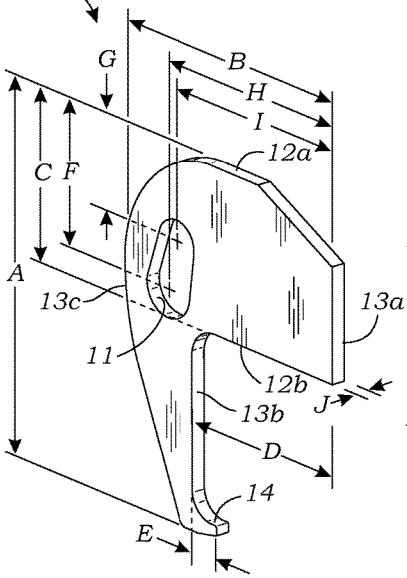
FIG. 5 is an enlarged perspective view of an exemplary catch plate thereof, in accordance with at least one embodiment.
Figure 10:
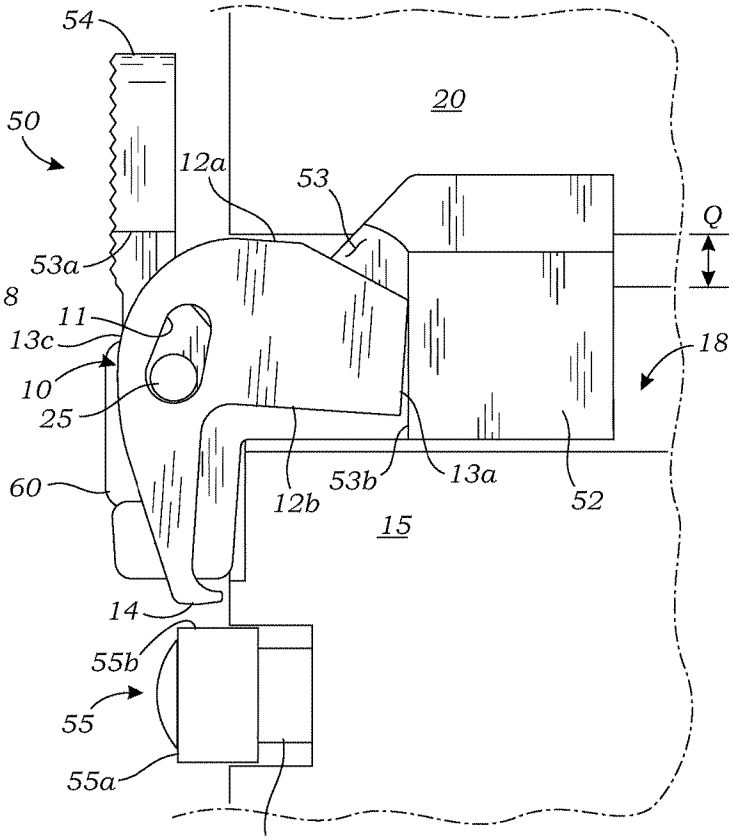
FIG. 10 is a partial cross-sectional view thereof corresponding to the second operational mode of FIG. 8, in accordance with at least one embodiment.

Referring next to FIG. 5, there is shown an enlarged perspective view of the exemplary catch plate 10 according to aspects of the present invention that is affixed alongside the bolt catch 50 (FIGS. 2-4) within the bolt catch mount 60 (FIGS. 2 and 4) and pivots on the mounting screw 25 (FIGS. 7 and 8), here the catch plate 10 configured for use in an AR15 rifle as the firearm 100, though again it will be appreciated that a variety of firearms and thus configurations of the catch plate 10 are possible according to aspects of the present invention without departing from its spirit and scope. In a bit more detail, the catch plate 10 is formed having a somewhat oval or oblong cross-hole 11 somewhat centrally, through which the mounting screw 25 passes in pivotally installing the bolt catch 50 and the catch plate 10 within the bolt catch mount 60, more about which is said below in connection with use of the apparatus as shown in FIGS. 7-10. With continued reference to FIG. 5, there is also shown formed on the catch plate 10 a lower receiver touch tip 14 that extends downwardly and protrudes substantially inwardly or toward the lower receiver 15 of the firearm 100 when the catch plate 10 is installed on the bolt catch mount 60 adjacent to the bolt catch 50. The touch tip 14 is configured to make selective contact specifically with the magazine release bar 55 (FIGS. 2 and 4) so as to prevent its actuation and the release of the magazine 45 (FIG. 2) when the upper and lower receivers 20, 15 are closed and the firearm 100 is thus assembled and operational, with the touch tip 14 being so positioned due to the upper edge 12 of the catch plate 10 being in contact with the upper receiver 20 when it is closed on the lower receiver 15. Put another way, it will thus be appreciated that the touch tip 14 is to be sufficiently long to make contact with the magazine release bar 55 installed in the lower receiver 15 when the catch plate 10 is shifted downwardly on the mounting screw 25 such that the touch tip 14 is biased downwardly and somewhat inwardly toward the firearm 100 as the upper end of the catch plate 10 opposite the touch tip 14 is also biased downwardly through contact with the upper receiver 20, in what is effectively the "at rest" or default "closed" condition of the catch plate 10, as explained in further detail below in connection with FIGS. 7 and 9. Conversely, when the upper receiver 20 is lifted or pivoted off of the lower receiver 15 and thus out of contact with, or at least to a position allowing upward movement of, the catch plate 10, the catch plate 10 thus travels upwardly and rotates slightly inwardly at the top around the oblong cross-hole 11 and mounting screw 25 so as to be clear of or allow outward movement of the magazine release bar 55 and thus allow actuation of the magazine release button 57 (FIGS. 1 and 3) when the firearm 100 is disabled, here as explained in further detail below in connection with FIGS. 8 and 10 illustrating the exemplary embodiment in the "open" or "disassembled" condition. Those skilled in the art will appreciate that other means of positioning or shifting the catch plate 10 relative to the receivers 20, 15 and/or the magazine release bar 55 are possible according to aspects of the present invention, such that the exemplary catch plate 10 configuration is to be understood as merely illustrative.

With continued reference to FIG. 5, the catch plate 10 has a number of features for which dimensions are provided, each of which having some effect on or relationship to the exemplary AR15 firearm 100 context and related bolt catch 50, here modified in essentially one main respect as explained in further detail below in connection with FIG. 6. As a threshold matter, it is to again be appreciated that the configuration of the catch plate 10 and the related dimensions indicated are merely illustrative in connection with an exemplary firearm 100 and thus non-limiting, as it will be further appreciated that the catch plate 10 can be scaled up and down and/or modified in other respects to suit particular alternative applications, including but not limited to the AR10 rifle, without departing from the spirit and scope of the invention. Staying with the exemplary AR15 context, those skilled in the art will appreciate that there are natural variances from manufacturer to manufacturer of the firearms 100 and related upper and lower receivers 20, 15 and that even relative to the same manufacturer certain dimensional tolerances will be allowed. As such, once more, all such dimensional information as herein provided for the catch plate 10 and other components is to be understood as merely illustrative and non-limiting. For purposes of such illustration, Table 1 below provides representative, nominal dimensions for the various geometrical features of the exemplary catch plate 10 of FIG. 5. It will be appreciated that measurements A-D together effectively define the overall profile of the catch plate 10 and effectively those portions that are received within the bolt catch well 18 (FIG. 3) alongside the modified bolt catch 50 and those that selective make contact with the upper receiver 20 and/or the magazine release bar 55. Regarding contact with the magazine release bar 55, it will again be appreciated that the somewhat hooked and inwardly projecting lower receiver touch tip 14 is configured to stand off a distance E from the second inside edge **13*b* so as to selectively contact the outer surface of the magazine release bar 55 as herein described, particularly further below in connection with FIGS. 7-10. Regarding the cross-hole 11 and its location and orientation on the catch plate 10, it is first noted that the somewhat oval or oblong cross-hole 11 has in its exemplary embodiment opposite curved or arced ends that are not exactly the same diameter, here the upper end of the cross-hole 11 defining a curve having a nominal diameter of approximately 0.092 in. and the opposite lower end of the cross-hole 11 defining a curve having a nominal diameter of approximately 0.110 in., more about which is said below. In terms of locating those two opposite ends of the oblong cross-hole 11, with reference to the centers of the respective upper and lower curves as illustrated in FIG. 5 and measurements F-I of Table 1, it will be appreciated that in the exemplary embodiment the overall length of the oblong cross-hole 11 is approximately 0.2 in. and is oriented at a slight inward angle relative to the upper edge 12*a* and the first inside edge 13*a*, for example, more about which is again said below, as particularly appreciated with reference to measurements H and I both measured horizontally from the first inside edge 13*a* to the centers of the respective lower and ends of the cross-hole 11**.

TABLE 1

Representative dimensions of catch plate 10

| Identifier | Description | Measurement (in.) |
|---|---|---|
| A | Overall height measured from upper edge 12a to bottom of lower receiver touch tip 14 | 0.745 |
| B | Overall width measured from first inside edge 13a to outside edge 13c | 0.670 |
| C | Height measured from upper edge 12a to lower edge 12b | 0.305 |
| D | Width measured from first inside edge 13a to second inside edge 13b | 0.400 |
| E | Width or stand-off of touch tip measured from the second inside edge 13b | 0.045 |
| F | Vertical distance from upper edge 12a to center of lower end of cross-hole 11 | 0.267 |
| G | Vertical distance from upper edge 12a to center of upper end of cross-hole 11 | 0.170 |
| H | Horizontal distance from first inside edge 13a to center of lower end of cross-hole 11 | 0.460 |
| I | Horizontal distance from first inside edge 13a to center of upper end of cross-hole 11 | 0.440 |
| J | Overall thickness | 0.048 |

Briefly, in terms of the material and method of construction of the exemplary catch plate 10, it will be appreciated that such may be formed of any suitable material, such as metal or plastic, through any suitable fabrication process, such as molding, casting, machining, stamping, laser-cutting, or forming, whether now known or later developed. In the exemplary embodiment, the catch plate 10 is formed from hardened 301 stainless steel, formed through a machining or laser-cutting process and then finished and heat treated in one or more secondary operations, though again a variety of other such metals and related manufacturing processes now known or later developed may be employed.

By way of further illustration and not limitation, the 301 stainless steel or other such metal may be supplied fully hardened, such as to C45 Rockwell, whereby a subsequent heat treat step is not required. Further, other metals or specifically steels such as 11-44 may be heat treated after machining or forming. Regardless, a further optional secondary process may be to black oxide, anodize, or otherwise surface treat the components such as the catch plate 10 to provide protection, as well as for aesthetics.

Figure 6:
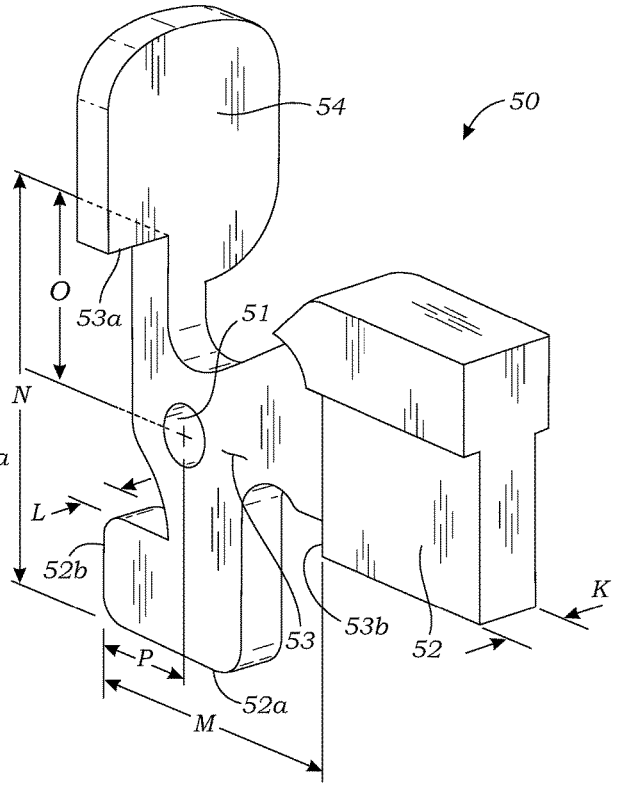
FIG. 6 is an enlarged perspective view of an exemplary bolt catch thereof, in accordance with at least one embodiment.

Turning to FIG. 6, there is shown an enlarged perspective view of a modified bolt catch 50 according to aspects of the present invention. In essence, in the exemplary embodiment, an industry standard or "mil spec" bolt catch 50 is formed initially or machined in a secondary operation so as to have an undercut 53 on one side of the body 52 in order to accommodate installation of the catch plate 10 substantially parallel or adjacent to or generally alongside the bolt catch 50 as together then pivotally installed within the bolt catch mount 60 and adjacent bolt catch well 18 of the lower receiver 15 as herein explained. To that end, the undercut 53 formed in the body 52 of the bolt catch 50 is in the exemplary embodiment configured or sized and shaped to accommodate the exemplary catch plate 10 as shown and described particularly in connection with FIG. 5. Once more, those skilled in the art will appreciate that a variety of configurations of both the bolt catch 50 and related catch plate 10 are possible according to aspects of the present invention beyond those disclosed, which are to be understood as merely illustrative and non-limiting. Even so, and with reference now to the below Table 2 that provides representative, nominal dimensions for the various geometrical features of the exemplary modified bolt catch 50 of FIG. 6. The overall nominal dimensional measurements M and N of the undercut 53 as being approximately 0.65 in.×0.62 in. will be appreciated as providing clearance for the head of the catch plate 10 having nominal dimensions of approximately 0.40 in.×0.30 in., even as it travels up and down on the oblong cross-hole 11 through a center-to-center distance of approximately 0.1 in. with related slight rotation, more about which is said below particularly in connection with FIGS. 9 and 10. Put another way in terms of the clearance, it can be observed that the location of the bolt catch cross-hole 51 both from the upper edge 53*a* of the undercut 53 as approximately 0.35 in. (measurement O) and from the inner edge 53*b* of the undercut 53 as approximately 0.5 in. (measurement M less measurement P) is greater than the maximum respective dimensions of the catch plate 10 as taken from the center of the lower end of the oblong cross-hole 11, which is furthest from both the upper edge 12*a* and the first inside edge 13*a*, measuring approximately 0.27 in. (measurement F) and approximately 0.46 in. (measurement H), respectively, such that the catch plate 10 will effectively be clear of the bolt catch tab 54 even as it rides up and/or cocks slightly inwardly relative to the bolt catch 50, as again shown and described further below in connection with FIGS. 9 and 10. Notably, while the undercut 53 at the upper edge 53*a* is shown as intersecting and thus removing a portion of the tab 54, it will be appreciated that even in the exemplary embodiment and certainly in other bolt catch arrangements such is not required, and thus the bolt catch tab 54 may be completely unaffected by the undercut 53. Similarly, regarding the thicknesses of the adjacent components, that of the undercut 53 formed in the body 52 of the bolt catch 50 is shown in the exemplary embodiment to be approximately 0.05 in. (measurement K less measurement L) while the nominal thickness of the catch plate 10 is in the exemplary embodiment approximately 0.048 in. (measurement J). Expecting at least a nominal 0.005 in. clearance between the body 52 of the bolt catch 50 and the sides of the bolt catch well 18, the result is in the exemplary embodiment a roughly 0.002-0.007 in. clearance between the catch plate 10 and the sides of the bolt catch well 18. Again, a variety of related configurations and geometrical arrangements and tolerances are possible according to aspects of the present invention without departing from its spirit and scope, such that all such dimensions are to be understood as illustrative and non-limiting.

TABLE 2

Representative dimensions of bolt catch 50

| Identifier | Description | Measurement (in.) |
|---|---|---|
| K | Overall thickness | 0.150 |
| L | Thickness of body 52 at undercut 53 | 0.100 |
| M | Horizontal distance from outside edge 52b to inner edge 53b of undercut 53 | 0.650 |
| N | Vertical distance from bottom edge 52a to upper edge 53a of undercut 53 | 0.620 |
| O | Vertical distance from upper edge 53a of undercut 53 to center of cross-hole 51 | 0.350 |
| P | Horizontal distance from outside edge 52b to center of cross-hole 51 | 0.150 |

Like the exemplary catch plate 10, it will be appreciated that the bolt catch 50 may also be formed of any suitable material, such as metal or plastic, through any suitable fabrication process, such as molding, casting, machining, stamping, laser-cutting, or forming, whether now known or later developed. In the exemplary embodiment, the bolt catch 50 is cast or machined from 8620 steel and then finished and heat treated in one or more secondary operations, though again a variety of other such metals and related manufacturing processes now known or later developed may be employed as herein described or otherwise known in the art. Such bolt catch 50 may be formed originally in the modified configuration disclosed herein having an undercut 53 to accommodate the catch plate 10, or for existing bolt catches 50, the undercut 53 may itself be machined in a secondary operation. It is also noted that while the illustrated bolt catch 50 is shown as having the typical tang or follower (not shown) removed to allow the bolt (not shown) to go forward after the last round is fired, such is not required and in other cases the bolt catch 50 would be unmodified in this respect.

Figure 7:
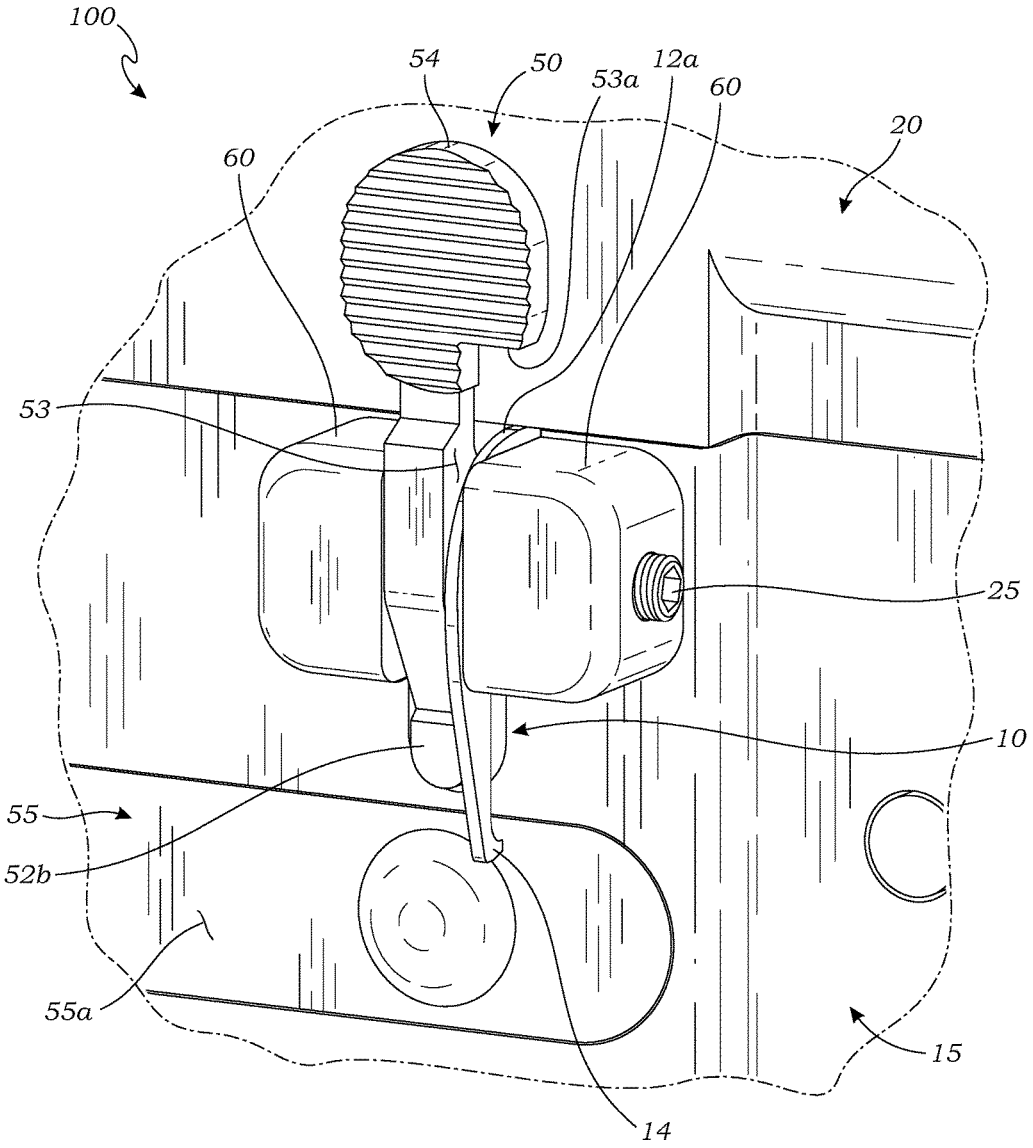
FIG. 7 is a partial assembled perspective view thereof in a first operational mode, in accordance with at least one embodiment.
Figure 8:
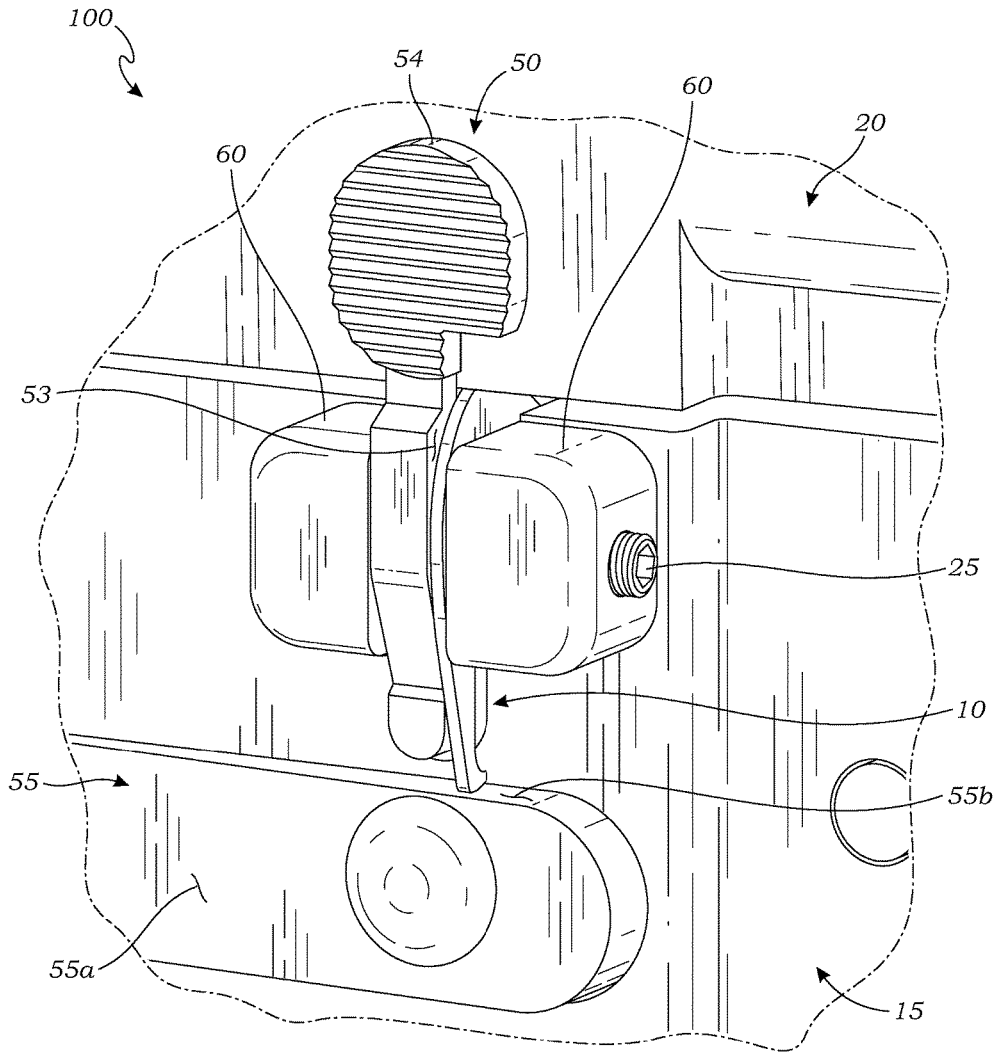
FIG. 8 is a partial assembled perspective view thereof in a second operational mode, in accordance with at least one embodiment.

Referring next to FIGS. 7 and 8, there are shown enlarged partial perspective views of the exemplary catch plate 10 and bolt catch 50 assembly as pivotally installed adjacent one another within the bolt catch mount 60 of the lower receiver 15 via the mounting screw 25. Once again, while a particular AR15 rifle is the illustrated firearm 100, the invention is not so limited, and thus other arrangements of the bolt catch 50 and bolt catch mount 60 and the related catch plate 10 according to aspects of the present invention are possible. Specifically, while a particular mounting screw 25 is shown, it will be appreciated that other fasteners now known or later developed may be employed, including but not limited to a bolt and nut, roll pin or rivet. In an exemplary embodiment, it is preferred that any such fastening means be semi-permanent, in that such fastener cannot be readily or easily removed without a tool. In FIG. 7, it will be appreciated that the action of the firearm 100 is "closed" with the upper receiver 20 seated on the lower receiver 15. As shown, in such position, the upper edge 12*a* of the catch plate 10 is substantially abutted by the upper receiver 20 while the opposite lower receiver touch tip 14 is positioned adjacent to and substantially in contact with the outside surface 55*a* of the magazine release bar 55, thereby preventing its outward movement and thus actuation of the integral magazine release button 57 (FIGS. 1 and 3). Accordingly, release of the magazine 45 (FIGS. 1 and 2) itself is prevented in this operable configuration of the firearm 100, rendering the firearm 100 a "fixed magazine" weapon. Then, as shown in FIG. 8, when the action of the firearm 100 is "opened," even if relatively slightly, as by pivoting the upper receiver 20 off of the lower receiver 15, such as by pulling or otherwise affecting the rear takedown pin 126 (FIGS. 1-3) so as to allow rotation between the upper and lower receivers 20, 15 about the front pivot pin 125 (FIGS. 1-3), the catch plate 10 is then able to shift upwardly into the clearance beneath the upper receiver 20, thereby lifting the opposite lower receiver touch tip 14 off of or clear of the magazine release bar 55 and thus allow its outward movement and release of the magazine 45 when the opposite magazine release button 57 is pushed. Accordingly, the magazine 45 is only able to be released according to aspects of the present invention when the firearm 100 is sufficiently disassembled or its action broken, wherein the movement of the magazine release assembly (bar 55 and button 57) is no longer constrained by the catch plate 10. Those skilled in the art will appreciate that upward movement of the catch plate 10 as the upper receiver 20 is pivoted off of the lower receiver 15 and the magazine release button 57 is pressed inwardly may be facilitated or assisted by the magazine release bar 55 itself, the somewhat rounded catch plate touch tip 14 effectively riding on the magazine release bar outer and upper surfaces 55*a*, 55*b*, more about which is said below in connection with FIGS. 9 and 10. When clear of the magazine release bar 55 as shown in FIG. 8, it will be further appreciated that the touch tip 14 may rest on top of the magazine release bar 55 or against its upper surface 55*b* or may be spaced a bit therefrom. Once more, it will be appreciated that a variety of related configurations of the catch plate 10 and other components and thus structure and operation are possible according to aspects of the present invention, such that those shown are to be understood as illustrative and non-limiting. By way of further example, those skilled in the art will appreciate that while the catch plate 10 is shown as positioned adjacent the right side of the bolt catch 50 as viewed in FIGS. 7 and 8, and thus that the undercut 53 formed on the body 52 of the bolt catch 50 is on the right side thereof, the invention may be just as easily practiced on the opposite or left side of the bolt catch 50.

Figure 9:
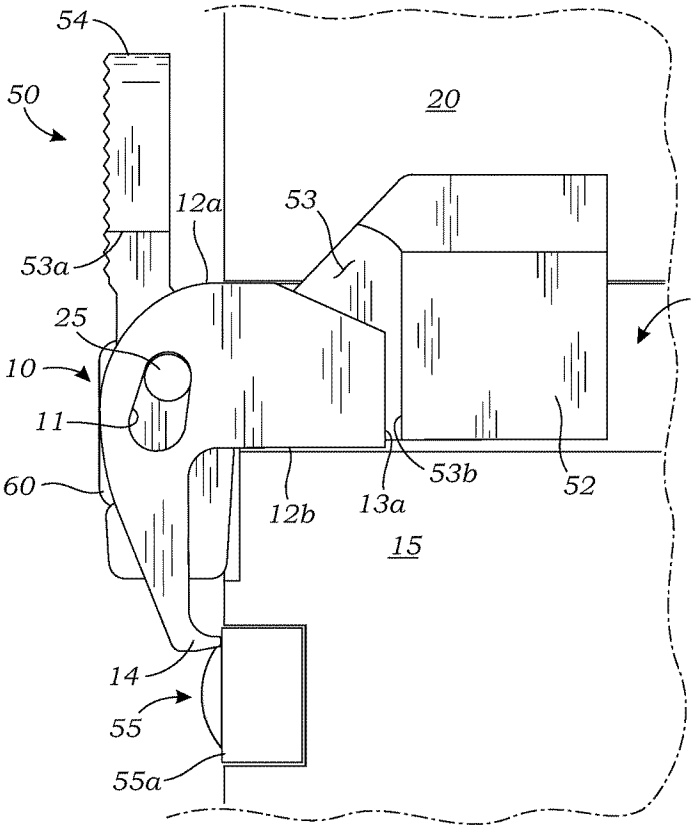
FIG. 9 is a partial cross-sectional view thereof corresponding to the first operational mode of FIG. 7, in accordance with at least one embodiment.

In operation, then, and now with further reference to the enlarged partial side schematic views of FIGS. 9 and 10, when the action of the firearm 100 is closed as shown in FIG. 9 with the upper receiver 20 substantially seated flush on the lower receiver 15, the upper edge 12*a* of the catch plate 10 is again substantially in contact with the upper receiver 20 such that the opposite lower receiver touch tip 14 of the catch plate 10 is then positioned adjacent to and substantially in contact with the outside surface 55*a* of the magazine release bar 55 so as to prevent its outward movement. Notably, in this position, the catch plate 10 is shifted such that the upper end of its oblong cross-hole 11 is adjacent or nearer to the mounting screw 25 or the like on which the both the catch plate 10 and the bolt catch 50 are pivotally mounted within the bolt catch mount 60 of the lower receiver 15, placing the catch plate 10 in its relatively lowest position relative to the bolt catch 50 and the lower receiver 15 more generally. As such, those skilled in the art will appreciate that the distance from the upper end of the catch plate cross-hole 11 to its touch tip 14, here of approximately 0.575 in. (measurement A less measurement G of FIG. 5 and Table 1), is configured to correlate to the distance between the vertical cross-hole and mounting screw 25 location and the vertical location of the magazine release bar 55 within the lower receiver 15, here again for the exemplary but not-limiting AR15 firearm 100. As also appreciated from FIG. 9, there is provided sufficient clearance between the perimeter of the catch plate 10 and the edges of the bolt catch undercut 53 for its movement from the "closed" or "locked" position of FIG. 9 to the "open" or "unlocked" position of FIG. 10, or specifically between the catch plate upper edge 12*a* and the bolt catch undercut upper edge 53*a* at the top and between the catch plate first inside edge 13*a* and the undercut inner edge 53*b* on the right as viewed in FIGS. 9 and 10. At the opposite lower end of the catch plate 10, the lower edge 12*b* is shown as being adjacent to and slightly spaced from the bottom of the bolt catch well 18, it being appreciated that some clearance is needed in order for the upper receiver 20 to fully close on the lower receiver 15 and that such clearance ultimately has no bearing on the function of the catch plate 10 to lock the magazine release bar 55 as herein described, with the catch plate 10 effectively clamped between the upper receiver 20 and the mounting screw 25 as nested in the upper end of the cross-hole 11. However, those skilled in the art will further appreciate that to the extent there is any tendency of the catch plate 10 to rotate around the mounting screw 25 while in the closed position, as when any attempt is made to push on the magazine release button 57 and thus push out on the magazine release bar 55 against the touch tip 14 of the catch plate 10, the lower edge 12*b* of the catch plate 10 would then seat on the bottom of the bolt catch well 18 and thereby further prevent any further rotation or movement of catch plate 10, however slight. In the exemplary embodiment, the spacing between the catch plate 10 and the bottom of the bolt catch well 18 when the catch plate 10 is in its lowest or closed position as illustrated in FIG. 9 would be approximately 0.005-0.030 in., though again those skilled in the art will appreciate that such is illustrative and non-limiting. Once the action of the firearm 100 is "broken" as by pivoting the upper receiver 20 off of the lower receiver 15 so as to form a gap therebetween as herein described and shown in FIG. 8 and here schematically in FIG. 10, the catch plate 10 shifts upwardly and slightly pivots inwardly on the mounting screw 25 when the magazine release button 57 is pressed in order to open or shift outwardly the magazine release bar 55 to release the magazine 45 (FIGS. 1 and 2), the catch plate 10 and its upper edge 12*a* being free to enter the gap temporarily formed between the upper and lower receivers 20, 15 and thus allowing the lower end of the catch plate 10 and the touch tip 14 specifically to move upwardly and/or slightly outwardly as the magazine release bar 55 is shifted outwardly. Here, it will be appreciated that with the upper end 12*a* of the catch plate 10 free to move up and rotate inwardly, as the magazine release bar 55 transitions outwardly, initially taking the touch tip 14 of the catch plate 10 with it and thus causing the catch plate 10 to rotate inwardly, or clockwise as viewed in FIGS. 9 and 10, about the mounting screw 25, this will naturally lift the catch plate 10 or cause the catch plate 10 to travel along the mounting screw 25 via the oblong and slightly angled cross-hole 11. Such geometry of the cross-hole 11 coupled with the somewhat rounded surfaces of the lower touch tip 14 again together contribute to the catch plate 10 traveling up and away from the lower receiver 15 even assisted by the magazine release bar 55 as the touch tip 14 rides on the outer and/or upper surface(s) 55*a*, 55*b* of the magazine release bar 55, which is again only possible when there is clearance above the catch plate 10 as when the upper receiver 20 is shifted off of the lower receiver 15 (i.e., the firearm 100 is disassembled or its action is "open" or "broken"). As illustrated in FIG. 10, the touch tip 14 is shown as being spaced from the upper surface 55*b* of the magazine release bar 55, though it will again be appreciated that the touch tip 14 may instead seat or rest on the upper surface 55*b* in such open configuration of the firearm 100, as again related to the overall geometry of the catch plate 10, and particularly the size and location of the cross-hole 11 relative to the other features. Specifically, in the exemplary embodiment, the size and orientation of the cross-hole 11 substantially dictates the limits and direction of travel of the catch plate 10, here, the total upward travel being effectively the distance between the centers of the respective upper and lower ends of the oblong cross-hole 11, which in the illustrated embodiment is approximately 0.1 in. (measurement F less measurement G of FIG. 5 and Table 1). As such, 0.1 in. would in the illustrated embodiment be the maximum amount of overhang of the catch plate 10, or the touch tip 14 specifically, relative to the vertical height or position of the magazine release bar 55 in the "closed" position of FIGS. 7 and 9, as that would be the approximate amount of travel upwardly that the catch plate 10 would make as the cross-hole 11 shifts along the mounting screw 25 to the "open" position of the firearm 100 shown in FIGS. 8 and 10; that is, the movement of the catch plate 10 is effectively constrained by the mounting screw 25 itself that passes through the cross-hole 11. It follows that in the exemplary embodiment the upper receiver 20 need only shift off of the lower receiver 15 also by approximately 0.1 in., which is indicated as measurement Q in FIG. 10, in order to provide sufficient clearance for the needed or geometrically constrained upward travel of the catch plate 10 in shifting the firearm 100 from closed (i.e., fixed magazine) to open (i.e., removable magazine). Once more, those skilled in the art will appreciate that all such geometries and configurations are to be understood as merely illustrative of features and aspects of the present invention and non-limiting. Relatedly, and similar to the observations made in connection with FIG. 9 illustrating the catch plate 10 and its relationship to the bolt catch 50 in the closed position, in the open position of FIG. 10, there is again provided sufficient clearance between the perimeter of the catch plate 10 and the edges of the bolt catch undercut 53 for its movement from the "closed" or "locked" position of FIG. 9 to the "open" or "unlocked" position of FIG. 10; here, in FIG. 10 it can be seen that there remains a gap or space between the catch plate upper edge 12*a* and the bolt catch undercut upper edge 53*a* at the top, beneath and clear of the tab 54, while along the side in the illustrated embodiment, due to the upward and slight inward rotational movement of the catch plate 10 so as have it slightly cocked relative to the bolt catch 50, it can be seen that the upper corner of the first inside edge 13*a* of the catch plate 10 may be in contact with the undercut inner edge 53*b* on the right as viewed in FIGS. 9 and 10. It will be appreciated that contact of the first inside edge 13*a* of the catch plate 10 with the undercut inner edge 53*b* of the bolt catch 50 would thus effectively prevent further rotational movement of the catch plate 10 about the mounting screw 25 and thus the maximum distance out from the lower receiver 15 and/or the magazine release bar 55 that the lower touch trip 14 may travel, while having little to no impact on the degree of vertical or upward travel of the catch plate 10, which is primarily dictated again by the geometry of the cross-hole 11. It will be further appreciated that frictional contact between all such engaging points or surfaces will have a further effect on particularly the upward travel of the catch plate 10 and its retention in the open position as illustrated in FIGS. 8 and 10 until the magazine release button 57 is released and the magazine release bar 55 returns to its inward "at rest" position and the upper receiver 20 is again then closed on the lower receiver 15 so as to force, along with gravity assistance, the catch plate 10 back down to its closed position as illustrated in FIGS. 7 and 9. Those skilled in the art will once more appreciate that a variety of related geometries and configurations are possible according to aspects of the present invention without departing from its spirit and scope. Again, once the magazine release button 57 is released or no longer depressed, the inwardly-biased magazine release bar 55 may once more shift inwardly toward its "at rest" or closed position, thereby clearing the lower end of the catch plate 10 and particularly the touch tip 14 and allowing the catch plate 10 to shift downwardly and rotate slightly outwardly on the mounting screw 25, thereby shifting the catch plate 10 back to its respective "at rest" position when the firearm 100 is to be closed or assembled with the touch tip 14 adjacent to the magazine catch bar 55, therefore allowing for the upper and lower receivers 20, 15 to be brought back together to again render the firearm 100 operational with its magazine 45 fixed. Those skilled in the art will again appreciate that a number of configurations of the catch plate 10 and related components are possible according to aspects of the present invention beyond those shown and described in selectively fixing the magazine 45 of a firearm 100 without departing from its spirit and scope, such that the size and shape of the exemplary catch plate 10 is to be understood as illustrative of features and aspects of the present invention and non-limiting. Notably, it will be appreciated with reference to the present disclosure that there is provided an apparatus and method for converting a semi-automatic firearm 100 from a fully-functioning firearm to a firearm having a selectively fixed magazine 45 and doing so without necessarily making any changes to the magazine release button assembly and without eliminating the bolt catch 55 and its functionality, rendering the "fixed magazine" compliant firearm 100 otherwise fully functional.

Figure 11:
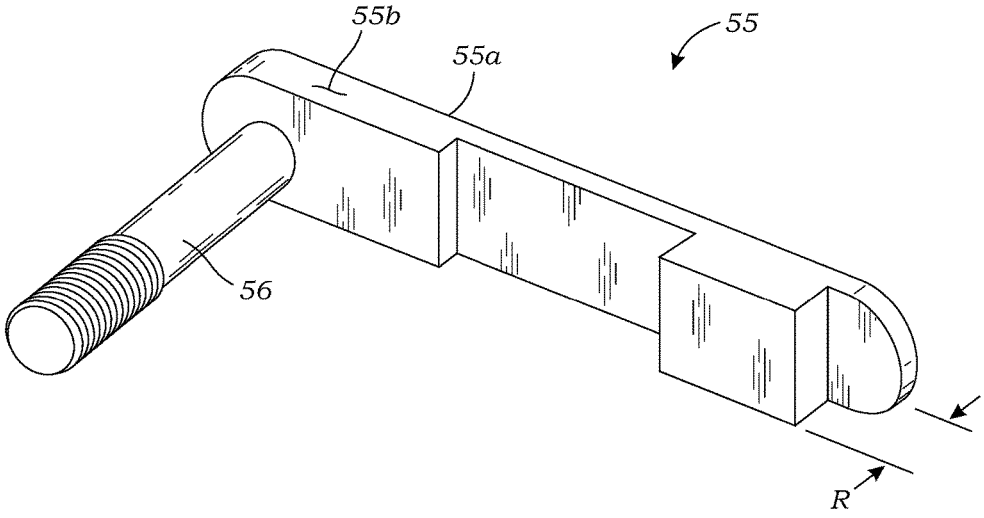
FIG. 11 is an enlarged perspective view of an exemplary magazine release bar thereof, in accordance with at least one embodiment.

Finally, turning briefly to FIG. 11, there is shown an enlarged perspective view of an alternative magazine release bar 55 as may be employed along with a catch plate 10 according to aspects of the present invention. In essence, in some firearms 100, or versions of the lower receiver 15 in the exemplary AR15 or AR10 rifle context, the depth of the well in which the magazine release bar 55 is received and/or the configuration of the magazine release bar 55 itself may be such that the outer surface 55*a* is more significantly recessed from the outer surface of the lower receiver 15 itself than that illustrated such as in FIG. 7, such that prior to actuation, the magazine release bar 55 may not protrude sufficiently outwardly to positively engage the touch tip 14 of the exemplary catch plate 10 so as to prevent unintended actuation of the magazine release or to effectively "fix" the magazine 45 (FIGS. 1 and 2) when the firearm 100 is closed. Or, put another way, actuation of the magazine release assembly (button 57 and bar 55) may be achieved without the magazine release bar 55 extending outwardly from the lower receiver 15 to the extent illustrated in FIG. 8. Accordingly, there is provided in the exemplary modified magazine release bar 55 shown in FIG. 11 such a bar 55 as having a relatively thicker body portion as designated by measurement R. For illustration, the increased thickness R of the modified magazine release bar 55 may be on the order of 0.275 in., as compared to a thickness of approximately 0.150 in. on a standard or mil-spec magazine release bar, though once more those skilled in the art will appreciate that a variety of firearm applications and thus arrangements of the magazine release bar 55 are possible according to aspects of the present invention beyond that shown and described, with the concept of the present invention being that in the closed or "at rest" position of the magazine release bar 55 its outer surface 55*a* would be substantially flush with or even slightly outward of the exterior of the lower receiver 15, or essentially flush with or slightly out of the related magazine release bar well formed in the lower receiver 15 or the like. As shown here in FIG. 11 and in FIG. 3, the magazine release bar 55 is further formed standard with a bolt 56 substantially perpendicular to its body at one end and configured to pass through the magazine release bore 19 formed in the lower receiver 15 so as to threadably or otherwise operably engage the opposite magazine release button 57. Those skilled in the art will further appreciate that based on the design and configuration of the catch plate 10 according to aspects of the present invention, when the upper receiver 20 is sufficiently pivoted off of the lower receiver 15 the catch plate 10 can be shifted up and out of the way sufficiently to allow for removal and/or replacement of the magazine release assembly (bar 55 and button 57) for any purpose advantageously without removal of the bolt catch 50. As with the catch plate 10 and the bolt catch 50, the magazine release bar 55 may also be formed of any suitable material, such as metal or plastic, through any suitable fabrication process, such as molding, casting, machining, stamping, laser-cutting, or forming, whether now known or later developed, including any optional black oxide, anodization, or other such secondary surface treatment.

In terms of installing the various components of the apparatus as illustrated and described herein, in an exemplary aftermarket or retrofit context, the initial steps involve removing standard components of the firearm 100 so as to accommodate the apparatus according to aspects of the present invention. For purposes of illustration, taking the exemplary AR15 rifle 100 as shown in FIGS. 1 and 2, first, the front pivot pin 125 and rear takedown pin 126 are removed so as to completely separate the upper receiver 20 from the lower receiver 15 and thereby expose the interior of the lower receiver 15. Next, the original or standard bolt catch (not shown) is removed from the lower receiver 15. If the bolt catch is secured via a screw threadably engaged with the bolt catch mount 60, such as a typical 6-32 mounting screw 25 formed having a 1/16 in. hex head, a 1/16 in. allen wrench or the like may be used to simply threadably remove the screw 25 temporarily so as to then completely remove the original bolt catch, taking care not to lose the related plunger and spring (not shown). If the original bolt catch is secured on the lower receiver bolt catch mount 60 instead via a roll pin (not shown) or the like, such can be hammered out as by using an appropriate punch and hammer or other such tool(s). Either way, once the original bolt catch is removed, the modified bolt catch 50 and catch plate 10 may be positioned adjacent to one another as best shown in FIGS. 3 and 9, with the catch plate 10 essentially nested against the bolt catch undercut 53 with the catch plate touch tip 14 pointed downwardly or away from the bolt catch tab 54 and the catch plate oblong cross-hole 11 substantially aligned with the bolt catch cross-hole 51, and the two components positioned within the bolt catch well 18 of the lower receiver 15 between the opposite bolt catch mounts 60 with their cross-holes 11, 51 also substantially aligned with the cross-holes (not shown) of the bolt catch mounts 60. Then, the mounting screw 25 or roll pin or other such fastener may simply be reinserted into the mount 60 so as to pivotally secure the modified bolt catch 50 and catch plate 10 on the lower receiver 15. The upper receiver 20 is then reinstalled on the lower receiver 15 via the front pivot pin 125 and the rear takedown pin 126 and the modified "fixed magazine" compliant firearm 100 is ready for use. The firearm 100 is thus rendered able to be quickly and easily disassembled sufficiently such that in conjunction with the operation of the catch plate 10 as described herein then enables the magazine 45 to be released when the action of the firearm 100 is open or "broken" while preventing release of the magazine 45, or fixing the magazine 45, when the action of the firearm 100 is closed or operational. Once more, those skilled in the art will appreciate that a variety of other components and configurations and related methods of installation and use are possible according to aspects of the present invention without departing from its spirit and scope, such that the exemplary embodiments shown and described are to be understood as illustrative and non-limiting.

In sum, according to aspects of the present invention there are provided a grouping of apparatuses which alone or in combination become an integral part of a semi-automatic firearm 100 whereby the firearm 100 is converted from one with a detachable magazine 45 into one with an effectively fixed magazine 45. The apparatuses are comprised of a catch plate 10, a modified bolt catch 50, and a modified magazine release bar 55, whereby the catch plate 10 constrains the magazine release bar 55 firmly within the magazine well 40 of the lower receiver 15 when the upper and lower receivers 20, 15 are secured together in a firing configuration. When the upper and lower receivers 20, 15 of the firearm 100 are in an open position or disassembled configuration, as by pulling the rear takedown pin 126 or employing any other device now known or later developed to allow selective separation of the upper receiver 20 from the lower receiver 15, the catch plate 10 freely moves substantially upward towards the upper receiver 20, allowing the magazine release bar 55 to shift outwardly away from the firearm 100 and the magazine 45 to be removed from the firearm 100 upon actuation of the magazine release button 57 and replaced with a new one. The user must re-seat the upper and lower receivers 20, 15 to then utilize the firearm 100. The catch plate 10 is fixed to the firearm 100 and cannot be removed without further disassembly of the firearm 100. Notably, the catch plate 10 does not replace the bolt catch 50 but mounts alongside the bolt catch 50 within the bolt catch mount 60 and so still allows the firearm 100 to have a bolt catch 50 even with a fixed magazine 45. A modified bolt catch 50 is provided with an undercut 53 to accommodate adjacent installation of the catch plate 10. And optionally, a modified magazine release bar 55 may be provided with a relatively thicker portion to ensure positive contact with the lower receiver touch tip 14 of the catch plate 10 when the upper and lower receivers 20, 15 are in the closed position. Once more, those skilled in the art will appreciate that a variety of configurations and combinations of such components, employing, as appropriate, parts, materials, and assembly methods whether now known or later developed, are possible according to aspects of the present invention without departing from its spirit and scope, such that the exemplary embodiments shown and described are to be understood as illustrative and non-limiting.

Aspects of the present specification may also be described as follows:

1. An apparatus for selectively fixing the magazine of a firearm having an upper receiver and a lower receiver selectively engaged with the upper receiver and comprising a bolt catch well and opposite bolt catch mounts having a bolt catch pivotally installed therebetween on a mounting screw, the lower receiver further comprising a magazine release bar and a mechanically coupled magazine release button together operably installed within the lower receiver, the apparatus comprising a catch plate configured to be pivotally installed adjacent to the bolt catch between the bolt catch mounts, the catch plate having a downwardly and inwardly-projecting lower receiver touch tip configured to make selective contact with the magazine release bar and having an opposite upper edge configured to make selective contact with the upper receiver, the catch plate further having an oblong cross-hole therebetween for receipt therethrough of the mounting screw for pivotal installation of the catch plate alongside the bolt catch, whereby upon installation the catch plate prevents actuation of the magazine release button as the lower receiver touch tip is positioned adjacent to the magazine release bar of the lower receiver and the upper edge is positioned adjacent to the upper receiver when the firearm is in the closed configuration of the upper and lower receivers and the catch plate allows actuation of the magazine release button as the catch plate shifts substantially upwardly along the oblong cross-hole with the upper edge clear of the upper receiver and the lower receiver touch tip clear of the magazine release bar when the firearm is in the open configuration of the upper and lower receivers.

2. The apparatus of embodiment 1 wherein an undercut is formed in a body of the bolt catch for selective receipt therein of the catch plate.

3. The apparatus of embodiment 2 wherein the depth of the undercut approximates the thickness of the catch plate, whereby both the bolt catch and the catch plate may be positioned alongside each other between the bolt catch mounts.

4. The apparatus of embodiment 2 or embodiment 3 wherein the bolt catch further comprises a bolt catch cross-hole for receipt therethrough of the mounting screw for pivotal installation of the bolt catch within the bolt catch mounts along with the catch plate.

5. The apparatus of embodiment 4 wherein the vertical distance from the center of the bolt catch cross-hole to an upper edge of the undercut is greater than the vertical distance from a lower end of the oblong cross-hole to the upper edge of the catch plate.

6. The apparatus of embodiment 4 or embodiment 5 wherein the horizontal distance from the center of the bolt catch cross-hole to an inner edge of the undercut is greater than the horizontal distance from the lower end of the oblong cross-hole to a first inside edge of the catch plate.

7. The apparatus of embodiment 5 or embodiment 6 wherein the vertical distance from the lower end of the oblong cross-hole to the upper edge of the catch plate is approximately 0.27 inch.

8. The apparatus of any of embodiments 5-7 wherein the horizontal distance from the lower end of the oblong cross-hole to the first inside edge of the catch plate is approximately 0.46 inch.

9. The apparatus of any of embodiments 5-8 wherein the horizontal distance from the upper end of the oblong cross-hole to the first inside edge of the catch plate is less than the horizontal distance from the lower end of the oblong cross-hole to the first inside edge of the catch plate, whereby the oblong cross-hole is at an angle in the catch plate.

10. The apparatus of any of embodiments 5-9 wherein the horizontal distance from the upper end of the oblong cross-hole to the first inside edge of the catch plate is approximately 0.44 inch.

11. The apparatus of any of embodiments 5-10 wherein the vertical distance from the upper end of the oblong cross-hole to the upper edge of the catch plate is approximately 0.17 inch.

12. The apparatus of any of embodiments 2-11 wherein the undercut is approximately 0.05 inch deep.

13. The apparatus of any of embodiments 1-12 wherein the oblong cross-hole is positioned substantially above the lower receiver touch tip.

14. The apparatus of any of embodiments 1-13 wherein the oblong cross-hole is positioned substantially outwardly of a second inside edge of the catch plate inset from the first inside edge.

15. The apparatus of embodiment 14 wherein the horizontal distance between the first and second inside edges is approximately 0.4 inch.

16. The apparatus of embodiment 14 or embodiment 15 wherein the catch plate further comprises a lower edge offset from the upper edge.

17. The apparatus of embodiment 16 wherein the lower edge intersects the second inside edge.

18. The apparatus of embodiment 17 wherein the lower edge and the second inside edge are substantially perpendicular.

19. The apparatus of any of embodiments 16-18 wherein the upper and lower edges are substantially parallel.

20. The apparatus of any of embodiments 16-19 wherein the vertical distance between the upper and lower edges is approximately 0.3 inch.

21. The apparatus of any of embodiments 14-20 wherein the lower receiver touch tip projects inwardly from the second inside edge of the catch plate.

22. The apparatus of any of embodiments 14-21 wherein the lower receiver touch tip projects inwardly from the second inside edge of the catch plate a horizontal distance of approximately 0.05 inch.

23. The apparatus of any of embodiments 1-22 wherein the oblong cross-hole has a diameter at an upper end that is less than a diameter at a lower end.

24. The apparatus of embodiment 23 wherein the upper end diameter is approximately 0.09 inch.

25. The apparatus of embodiment 23 or embodiment 24 wherein the lower end diameter is approximately 0.11 inch.

26. The apparatus of any of embodiments 1-25 wherein the center-to-center length of the oblong cross-hole is approximately 0.1 inch.

27. The apparatus of any of embodiments 1-26 wherein the thickness of the catch plate is approximately 0.05 inch.

28. The apparatus of any of embodiments 1-27 wherein the overall thickness of the bolt catch is approximately 0.15 inch.

29. The apparatus of any of embodiments 1-28 wherein the overall height of the catch plate as the vertical distance from the upper edge to the lower receiver touch tip is approximately 0.75 inch.

30. The apparatus of any of embodiments 1-29 wherein the overall width of the catch plate as the horizontal distance from the first inside edge to an outside edge is approximately 0.67 inch.

31. The apparatus of any of embodiments 1-30 wherein the maximum thickness of the magazine release bar is approximately 0.28 inch.

32. The apparatus of any of embodiments 1-31 wherein when the firearm is in the open configuration a gap is formed between the upper receiver and the lower receiver substantially at the bolt catch of at least approximately 0.1 inch.

33. The apparatus of any of embodiments 1-32 wherein when the firearm is in the closed configuration of the upper and lower receivers the lower receiver touch tip is in contact with an outside surface of the magazine release bar.

34. The apparatus of any of embodiments 1-33 wherein when the firearm is in the open configuration of the upper and lower receivers the lower receiver touch tip is in contact with an upper surface of the magazine release bar.

35. A method of employing an apparatus for selectively fixing the magazine of a firearm as defined in any one of embodiments 1-34, the method comprising the steps of alternately closing the upper receiver on the lower receiver to cause the upper receiver to contact the upper edge of the catch plate and so position the lower receiver touch tip adjacent to the magazine release bar of the lower receiver in order to prevent actuation of the magazine release button when the firearm is in the closed configuration of the upper and lower receivers, and alternately opening the upper receiver at least partially off of the lower receiver so as to allow the catch plate to travel upwardly and so position the lower receiver touch tip clear of the magazine release bar in order to allow actuation of the magazine release button when the firearm is in the open configuration of the upper and lower receivers.

36. The method of embodiment 35, wherein the step of alternately closing the upper receiver on the lower receiver causes the upper edge of the catch plate to be substantially in contact and square with the upper receiver.

37. The method of embodiment 35 or embodiment 36, wherein the step of alternately closing the upper receiver on the lower receiver effectively squeezes the catch plate between the upper receiver and the bolt catch mounting screw.

38. The method of any of embodiments 35-37, wherein the step of alternately closing the upper receiver on the lower receiver effectively seats the bolt catch mounting screw within the upper end of the oblong cross-hole.

39. The method of any of embodiments 35-38, wherein the step of alternately opening the upper receiver at least partially off of the lower receiver creates a clearance between the upper edge of the catch plate and the upper receiver.

40. The method of any of embodiments 35-39, wherein the step of alternately opening the upper receiver at least partially off of the lower receiver comprises pulling the rear takedown pin.

41. The method of any of embodiments 35-40, wherein the step of alternately opening the upper receiver at least partially off of the lower receiver is followed by pressing the magazine release button so as to shift the magazine release bar outwardly and release the magazine.

42. The method of embodiment 41, wherein the step of pressing the magazine release button so as to shift the magazine release bar outwardly causes the magazine release bar to push the lower receiver touch tip and thus the catch plate outwardly and upwardly along the mounting screw positioned within the oblong cross-hole of the catch plate.

43. The method of any of embodiments 35-42, further comprising replacing an original bolt catch on the firearm with the modified bolt catch with undercut.

44. The method of embodiment 43, wherein the step of replacing the original bolt catch with the modified bolt catch comprises the further step of seating the catch plate within the undercut.

45. The method of embodiment 43 or embodiment 44, wherein the step of replacing the original bolt catch with the modified bolt catch comprises the further steps of positioning the modified bolt catch and catch plate within the bolt catch mount and installing the mounting screw through the bolt catch mount, the oblong cross-hole of the catch plate, and the bolt catch cross-hole.

46. The method of any of embodiments 43-45, wherein the step of replacing the original bolt catch with the modified bolt catch comprises the further step of machining the undercut in the original bolt catch to form the modified bolt catch.

47. The method of any of embodiments 35-46, further comprising replacing an original magazine release bar on the firearm with the modified magazine release bar.

48. A kit comprising an apparatus for selectively fixing the magazine of a firearm as defined in any one of embodiments 1-34.

49. The kit of embodiment 48, comprising both the catch plate and the modified bolt catch.

50. The kit of embodiment 48 or embodiment 49, further comprising the modified magazine release bar.

51. The kit of any of embodiments 48-50, further comprising instructional material.

52. The kit of embodiment 51, wherein the instructional material provides instructions on how to perform the method as defined in any one of embodiments 35-47.

53. A firearm comprising an apparatus for selectively fixing the magazine thereof as defined in any one of embodiments 1-34.

54. Use of an apparatus for selectively fixing the magazine of a firearm as defined in any one of embodiments 1-34 to selectively prevent actuation of the magazine release button of the firearm.

55. The use of embodiment 54, wherein the use comprises a method as defined in any one of embodiments 35-47.

56. An apparatus for selectively fixing the magazine of a firearm having an upper receiver and a lower receiver selectively engaged with the upper receiver and comprising a bolt catch well and opposite bolt catch mounts, the lower receiver further comprising a magazine release bar and a mechanically coupled magazine release button together operably installed within the lower receiver, the apparatus comprising a bolt catch having an undercut and configured to be pivotally installed on a mounting screw within the bolt catch mounts as passing through a bolt catch cross-hole, the apparatus further comprising a catch plate configured to be pivotally installed adjacent to the bolt catch between the bolt catch mounts as by nesting within the undercut, the catch plate having a downwardly and inwardly-projecting lower receiver touch tip configured to make selective contact with the magazine release bar and having an opposite upper edge configured to make selective contact with the upper receiver, the catch plate further having an oblong cross-hole therebetween for alignment with the bolt catch cross-hole and receipt therethrough of the mounting screw for pivotal installation of the catch plate alongside the bolt catch, whereby upon installation the catch plate prevents actuation of the magazine release button as the lower receiver touch tip is positioned adjacent to the magazine release bar of the lower receiver and the upper edge is positioned adjacent to the upper receiver when the firearm is in the closed configuration of the upper and lower receivers and the catch plate allows actuation of the magazine release button as the catch plate shifts substantially upwardly along the oblong cross-hole with the upper edge clear of the upper receiver and the lower receiver touch tip clear of the magazine release bar when the firearm is in the open configuration of the upper and lower receivers.

57. An apparatus for selectively fixing the magazine of a firearm having an upper receiver and a lower receiver selectively engaged with the upper receiver and comprising a bolt catch well and opposite bolt catch mounts having a bolt catch pivotally installed therebetween on a mounting screw, the apparatus comprising a magazine release bar having an increased thickness and configured to be mechanically coupled with a magazine release button so as to together be operably installed within the lower receiver, the apparatus further comprising a catch plate configured to be pivotally installed adjacent to the bolt catch between the bolt catch mounts, the catch plate having a downwardly and inwardly-projecting lower receiver touch tip configured to make selective contact with the magazine release bar and having an opposite upper edge configured to make selective contact with the upper receiver, the catch plate further having an oblong cross-hole therebetween for alignment with the bolt catch cross-hole and receipt therethrough of the mounting screw for pivotal installation of the catch plate alongside the bolt catch, whereby upon installation the catch plate prevents actuation of the magazine release button as the lower receiver touch tip is positioned adjacent to the magazine release bar of the lower receiver and the upper edge is positioned adjacent to the upper receiver when the firearm is in the closed configuration of the upper and lower receivers and the catch plate allows actuation of the magazine release button as the catch plate shifts substantially upwardly along the oblong cross-hole with the upper edge clear of the upper receiver and the lower receiver touch tip clear of the magazine release bar when the firearm is in the open configuration of the upper and lower receivers.

58. An apparatus for selectively fixing the magazine of a firearm having an upper receiver and a lower receiver selectively engaged with the upper receiver and comprising a bolt catch well and opposite bolt catch mounts, the apparatus comprising a magazine release bar having an increased thickness and mechanically coupled with a magazine release button so as to together be operably installed within the lower receiver, the apparatus further comprising a bolt catch having an undercut and pivotally installed on a mounting screw within the bolt catch mounts as passing through a bolt catch cross-hole, and the apparatus further comprising a catch plate configured to be pivotally installed adjacent to the bolt catch between the bolt catch mounts as by nesting within the undercut, the catch plate having a downwardly and inwardly-projecting lower receiver touch tip configured to make selective contact with the magazine release bar and having an opposite upper edge configured to make selective contact with the upper receiver, the catch plate further having an oblong cross-hole therebetween for alignment with the bolt catch cross-hole and receipt therethrough of the mounting screw for pivotal installation of the catch plate alongside the bolt catch, whereby upon installation the catch plate prevents actuation of the magazine release button as the lower receiver touch tip is positioned adjacent to the magazine release bar of the lower receiver and the upper edge is positioned adjacent to the upper receiver when the firearm is in the closed configuration of the upper and lower receivers and the catch plate allows actuation of the magazine release button as the catch plate shifts substantially upwardly along the oblong cross-hole with the upper edge clear of the upper receiver and the lower receiver touch tip clear of the magazine release bar when the firearm is in the open configuration of the upper and lower receivers.

In closing, regarding the exemplary embodiments of the present invention as shown and described herein, it will be appreciated that apparatuses and related methods are herein disclosed and configured for selectively fixing the magazine of a firearm that could otherwise be characterized as an assault weapon. Because the principles of the invention may be practiced in a number of configurations beyond those shown and described, it is to be understood that the invention is not in any way limited by the exemplary embodiments and is able to take numerous forms without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

In some embodiments, the numbers expressing quantities of ingredients, properties such as concentration, reaction conditions, and so forth, used to describe and claim certain embodiments of the inventive subject matter are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the inventive subject matter are approximations, the numerical values set forth in the specific examples are reported as precisely as practicable. The numerical values presented in some embodiments of the inventive subject matter may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. The recitation of numerical ranges of values herein is merely intended to serve as a shorthand method of referring individually to each separate value falling within the range. Unless otherwise indicated herein, each individual value of a numerical range is incorporated into the specification as if it were individually recited herein. Similarly, all lists of values should be considered as inclusive of intermediate values unless the context indicates the contrary.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated.

All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the inventive subject matter and does not pose a limitation on the scope of the inventive subject matter otherwise claimed. No language in the application should be construed as indicating any non-claimed element essential to the practice of the invention.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. An apparatus for selectively fixing the magazine of a firearm having an upper receiver and a lower receiver selectively engaged with the upper receiver and comprising a bolt catch well and opposite bolt catch mounts having a bolt catch pivotally installed therebetween on a mounting screw, the lower receiver further comprising a magazine release bar and a mechanically coupled magazine release button together operably installed within the lower receiver, the apparatus comprising:

a catch plate configured to be pivotally installed adjacent to the bolt catch between the bolt catch mounts, the catch plate having a downwardly and inwardly-projecting lower receiver touch tip configured to make selective contact with the magazine release bar and having an opposite upper edge configured to make selective contact with the upper receiver, the catch plate further having an oblong cross-hole therebetween for receipt therethrough of the mounting screw for pivotal installation of the catch plate alongside the bolt catch, whereby upon installation the catch plate prevents actuation of the magazine release button as the lower receiver touch tip is positioned adjacent to the magazine release bar of the lower receiver and the upper edge is positioned adjacent to the upper receiver when the firearm is in the closed configuration of the upper and lower receivers and the catch plate allows actuation of the magazine release button as the catch plate shifts upwardly along the oblong cross-hole with the upper edge clear of the upper receiver and the lower receiver touch tip clear of the magazine release bar when the firearm is in the open configuration of the upper and lower receivers.

2. The apparatus of claim 1 wherein an undercut is formed in a body of the bolt catch for selective receipt therein of the catch plate.

3. The apparatus of claim 2 wherein the depth of the undercut approximates the thickness of the catch plate, whereby both the bolt catch and the catch plate may be positioned alongside each other between the bolt catch mounts.

4. The apparatus of claim 2 wherein the bolt catch further comprises a bolt catch cross-hole for receipt therethrough of the mounting screw for pivotal installation of the bolt catch within the bolt catch mounts along with the catch plate.

5. The apparatus of claim 4 wherein the vertical distance from the center of the bolt catch cross-hole to an upper edge of the undercut is greater than the vertical distance from a lower end of the oblong cross-hole to the upper edge of the catch plate.

6. The apparatus of claim 5 wherein the horizontal distance from the center of the bolt catch cross-hole to an inner edge of the undercut is greater than the horizontal distance from the lower end of the oblong cross-hole to a first inside edge of the catch plate.

7. The apparatus of claim 5 wherein the horizontal distance from the upper end of the oblong cross-hole to the first inside edge of the catch plate is less than the horizontal distance from the lower end of the oblong cross-hole to the first inside edge of the catch plate, whereby the oblong cross-hole is at an angle in the catch plate.

8. The apparatus of claim 2 wherein the undercut is 0.05 inch deep.

9. The apparatus of claim 1 wherein the oblong cross-hole is positioned above the lower receiver touch tip.

10. The apparatus of claim 1 wherein the oblong cross-hole is positioned outwardly of a second inside edge of the catch plate inset from a first inside edge.

11. The apparatus of claim 10 wherein the catch plate further comprises a lower edge offset from the upper edge.

12. The apparatus of claim 11 wherein the lower edge intersects the second inside edge.

13. The apparatus of claim 12 wherein the lower edge and the second inside edge are perpendicular.

14. The apparatus of claim 11 wherein the upper and lower edges are parallel.

15. The apparatus of claim 10 wherein the lower receiver touch tip projects inwardly from the second inside edge of the catch plate.

16. The apparatus of claim 1 wherein the oblong cross-hole has a diameter at an upper end that is less than a diameter at a lower end.

17. The apparatus of claim 1 wherein the center-to-center length of the oblong cross-hole is 0.1 inch.

18. The apparatus of claim 1 wherein the thickness of the catch plate is 0.05 inch.

19. An apparatus for selectively fixing the magazine of a firearm having an upper receiver and a lower receiver selectively engaged with the upper receiver and comprising a bolt catch well and opposite bolt catch mounts, the lower receiver further comprising a magazine release bar and a mechanically coupled magazine release button together operably installed within the lower receiver, the apparatus comprising:

a bolt catch having an undercut and configured to be pivotally installed on a mounting screw within the bolt catch mounts as passing through a bolt catch cross-hole; and a catch plate configured to be pivotally installed adjacent to the bolt catch between the bolt catch mounts as by nesting within the undercut, the catch plate having a downwardly and inwardly-projecting lower receiver touch tip configured to make selective contact with the magazine release bar and having an opposite upper edge configured to make selective contact with the upper receiver, the catch plate further having an oblong cross-hole therebetween for alignment with the bolt catch cross-hole and receipt therethrough of the mounting screw for pivotal installation of the catch plate alongside the bolt catch, whereby upon installation the catch plate prevents actuation of the magazine release button as the lower receiver touch tip is positioned adjacent to the magazine release bar of the lower receiver and the upper edge is positioned adjacent to the upper receiver when the firearm is in the closed configuration of the upper and lower receivers and the catch plate allows actuation of the magazine release button as the catch plate shifts upwardly along the oblong cross-hole with the upper edge clear of the upper receiver and the lower receiver touch tip clear of the magazine release bar when the firearm is in the open configuration of the upper and lower receivers.

20. A firearm having an upper receiver and a lower receiver selectively engaged with the upper receiver and comprising a bolt catch well and opposite bolt catch mounts having a bolt catch pivotally installed therebetween on a mounting screw, the lower receiver further comprising a magazine release bar and a mechanically coupled magazine release button together operably installed within the lower receiver, the firearm comprising an apparatus for selectively fixing the magazine thereof, the apparatus comprising:

a catch plate pivotally installed adjacent to the bolt catch between the bolt catch mounts, the catch plate having a downwardly and inwardly-projecting lower receiver touch tip configured to make selective contact with the magazine release bar and having an opposite upper edge configured to make selective contact with the upper receiver, the catch plate further having an oblong cross-hole therebetween for receipt therethrough of the mounting screw for pivotal installation of the catch plate alongside the bolt catch, whereby the catch plate prevents actuation of the magazine release button as the lower receiver touch tip is positioned adjacent to the magazine release bar of the lower receiver and the upper edge is positioned adjacent to the upper receiver when the firearm is in the closed configuration of the upper and lower receivers and the catch plate allows actuation of the magazine release button as the catch plate shifts upwardly along the oblong cross-hole with the upper edge clear of the upper receiver and the lower receiver touch tip clear of the magazine release bar when the firearm is in the open configuration of the upper and lower receivers.

* * * * *